United States Patent [19]

Litwack et al.

[11] 4,301,849

[45] Nov. 24, 1981

[54] REVERSIBLE BAG

[75] Inventors: Zita Litwack, New York, N.Y.; Barry W. Hoberman, Hazlet, N.J.; Emil R. Najman, Brooklyn, N.Y.

[73] Assignee: Joseph Novogrodsky, New York, N.Y.

[21] Appl. No.: 83,714

[22] Filed: Oct. 22, 1979

[51] Int. Cl.[3] ..... A45C 13/26

[52] U.S. Cl. ..... 150/33; 190/41 Z; 150/28 R; 150/42

[58] Field of Search ..... 150/28 R, 28 A, 33, 150/42, 3; 190/41 Z; 24/205.16 R

[56] References Cited

U.S. PATENT DOCUMENTS

| | | | |
|---|---|---|---|
| 1,760,681 | 5/1930 | Barol | 150/28 R |
| 1,832,715 | 11/1931 | London | 150/3 X |
| 1,974,872 | 9/1934 | Lunn | 150/3 |
| 2,017,410 | 10/1935 | Hiering | 150/42 UX |
| 2,122,171 | 6/1938 | Alexander | 150/1 X |
| 3,108,627 | 10/1963 | Tatelmon | 150/28 A |
| 3,403,716 | 10/1968 | Siris | 150/28 R |
| 3,550,663 | 12/1970 | Johnston | 150/28 R |
| 4,085,873 | 4/1978 | Schweitzer | 150/28 R X |

FOREIGN PATENT DOCUMENTS

| | | | |
|---|---|---|---|
| 37196 | 8/1968 | German Democratic Rep. | 150/28 R |
| 326029 | 11/1957 | Switzerland | 150/28 R |

*Primary Examiner*—Donald F. Norton

*Attorney, Agent, or Firm*—Lackenbach, Siegel, Marzullo, Presta & Aronson

[57] ABSTRACT

A reversible bag with finished inner and outer surfaces is provided with a reversible zipper, and with handles attached to the inner portion and to the outer portion of said reversible bag.

9 Claims, 14 Drawing Figures

REVERSIBLE BAG

BACKGROUND OF THE INVENTION

For many centuries handbags have been extensively used by both men and women. Though they were originally created to serve the purpose of providing a place to carry things, over the years they have evolved into a significant fashion piece. Few, if any, women now have only one hand bag. They usually own many handbags, each having different styles and/or colors. Presumably, each of these different handbags has been purchased to complement a particular set of clothing.

In order to reduce the cost of purchasing handbags, reversible handbags have been provided. In this way, a woman would have a single bag which could be used with two different color fashion designs. Over the years, such reversible handbags have had moderate popularity. An example of one such reversible handbag is one designed by Johnston (U.S. Pat. No. 3,550,663).

One of the major problems affecting the success and popularity of such reversible handbags is that there is not yet an adequate means to close these bags. Many of the bags, such as Johnston's, are open-topped and there has been no attempt to provide a closure means. Other designers and manufacturers have attempted to use snaps or the like, but this has proved equally ineffective. The crux of the problem is that the items inside the bag may fall from the bag when the orientation of the bag is upset. Further, inclement weather can frequently cause a problem. Rain, snow and other unwanted elements are free to fall inside the bag and cause damage to the contents.

SUMMARY OF THE INVENTION

Therefore, applicants have provided a new and unique reversible bag which includes a top closure means, such as a reversible zipper.

In addition, applicants have created such a bag so that it will still be lightweight and washable.

To accomplish their purpose, applicants have attached a reversible zipper to the open end of a bag. In such manner, the interior region of the bag is effectively closed to the outside elements. Therefore, elements are protected from falling from the bag and the contents of the bag are protected from rain, snow and the like. Because a reversible zipper is used, when the bag is reversed, the zipper may still be operable.

For added convenience, pockets may be included on the outer surfaces of the reversible bag. Handles can be provided in any one of several possible locations. Furthermore, the bag can be made in any desirable shape and size. Large, rectangular travelling bags, as well as small, clutch-type purses, may be made using the principles of this invention.

DETAILED DESCRIPTION OF THE INVENTION

Figure 1:
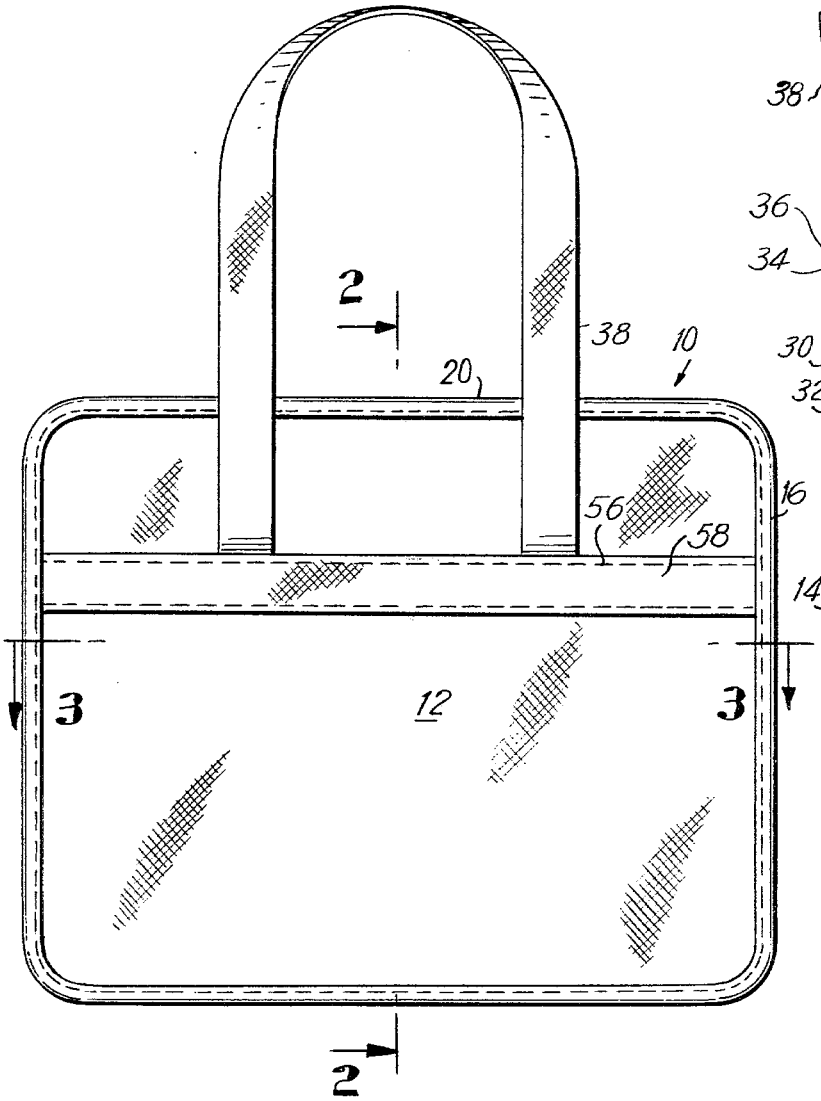
FIG. 1 is a front elevational view of a reversible bag.

Referring now to FIGS. 1–4, a first embodiment of a reversible bag 10 is shown. The bag 10 is essentially a rectangular type and includes an outer front portion 12, an outer rear portion 14, outer side portions 16, an outer bottom portion 18 and an outer top portion 20. These portions can be assembled in any known manner, such as by stitching, in order to fabricate the bag 10. The outer top portion 20 may comprise two opposing top panels 22 and 24. The panels 22 and 24 preferably define an opening therebetween which provides entry into an interior region 26 of the bag 10. A reversible zipper 28 is included to close the opening between the top panels 22 and 24 and is attached to the outer top portion 20 of the bag 10.

Figure 2:
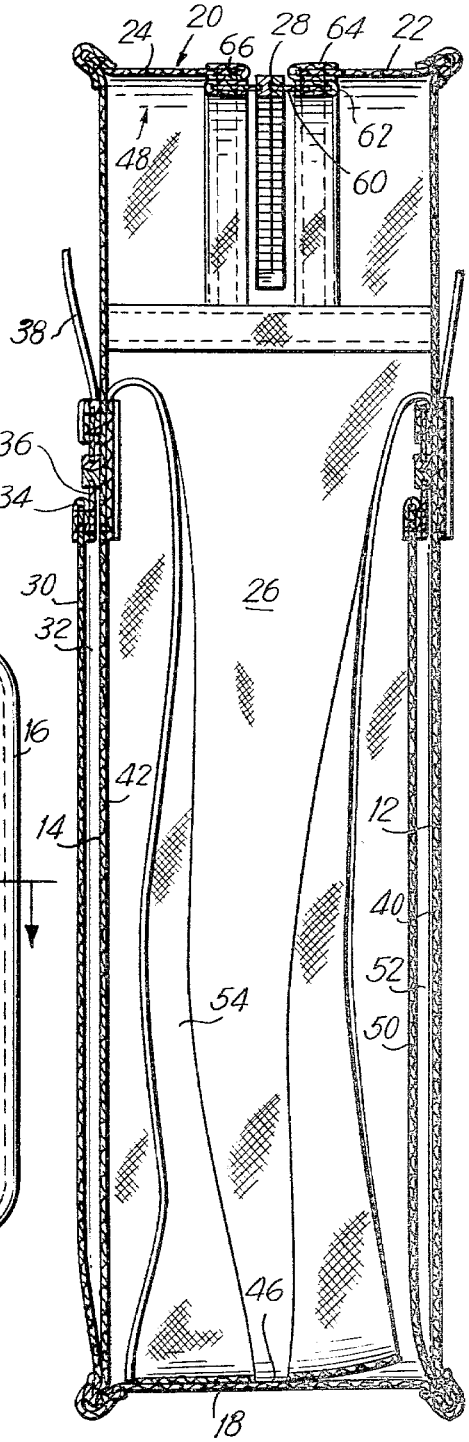
FIG. 2 is a cross-sectional view taken substantially along the lines 2—2 of FIG. 1, and showing in the interior of the bag the exterior pocket and handles for the bag when the bag is reversed.
Figure 3:
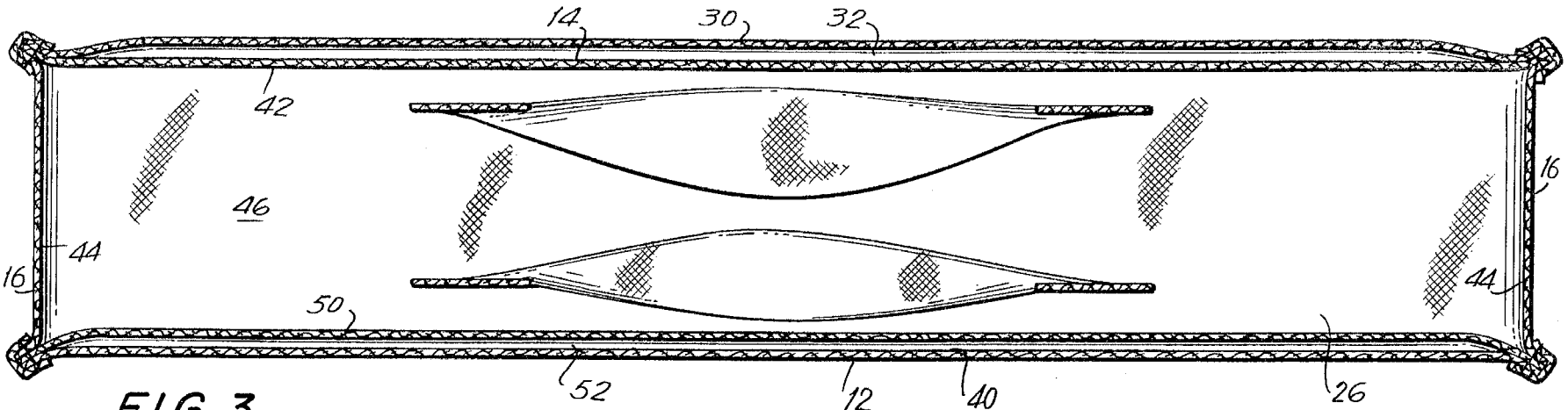
FIG. 3 is a cross-sectional view of the interior of the bag taken substantially along the lines 3—3 of FIG. 1.

The zipper may be attached to the bag in the manner illustrated in FIG. 2. Strippings 62 are placed over the webbings 60 of the zipper and are stitched thereto. Strippings 64 are bent around the distal ends 66 of the top panels 22 and 24 and stitched thereto. Then the strippings 62, along with the webbings 60 of the zipper, are stitched to the strippings 64 of the top panels. If desired, the strippings 62 can be omitted and the webbings 60 can be stitched directly to the strippings 64. The basic function of the strippings 62 and 64 is decorative. If desired, other means may be used to attractively disguise the attachment of the zipper. Further, other methods may be used to attach the webbing of the zipper to the top panels, such as by the use of adhesives.

Figure 14:
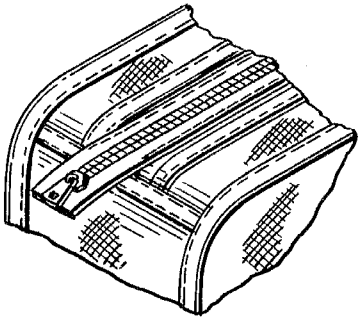
FIG. 14 is a perspective view showing another manner in which to mount the zipper on the bag.

The zipper may be positioned in different manners to the bag. For instance, the zipper 28 (see FIGS. 1–4) may extend not only along the top portion of the bag, but also extend down each of the side portions. In some embodiments, it may be desirable to not extend the zipper down the respective side portions (see FIGS. 5 and 9). On the other hand, it is quite possible that a portion of the zipper may overhang the side of the bag on one or both sides of the bag (see FIG. 14). The only essential requirement of the positioning of the zipper is that it be reversible, so that it may be operated from either side of the bag.

Positioned over the surface of the outer rear portion 14 is a pocket panel 30. By means of stitching, or other suitable means, the pocket panel 30 may be attached on three sides to the reversible bag 10, the top end 34 of the pocket panel 30 being left unattached. By such means, a pocket 32 is defined between the outer rear portion 14 and the pocket panel 30. An appropriate zipper 36 may be attached across the top edge 34 of the pocket panel 30 to close off the pocket 32. Handles 38 may be attached to the bag at suitable locations along the outer front portion 12 and the outer rear portion 14.

The inner region 26 of the bag 10 includes an inner front portion 40, an inner rear portion 42, inner side portions 44, an inner bottom portion 46 and an inner top portion 48.

These portions are the reverse sides of the outer front portion 12, the outer rear portion 14, the outer side portions 16, the outer bottom portion 18 and the outer top portion 20, respectively. An inner pocket panel 50 may be attached to the inner front portion 40 in a manner similar to which the pocket panel 30 was attached to the outer rear portion 14, Thus, an inner pocket 52 will be defined between the inner front portion 40 and the inner pocket panel 50. A second set of handles 54 is appropriately attached to the inner front portion 40 and the inner rear portion 42.

Figure 4:
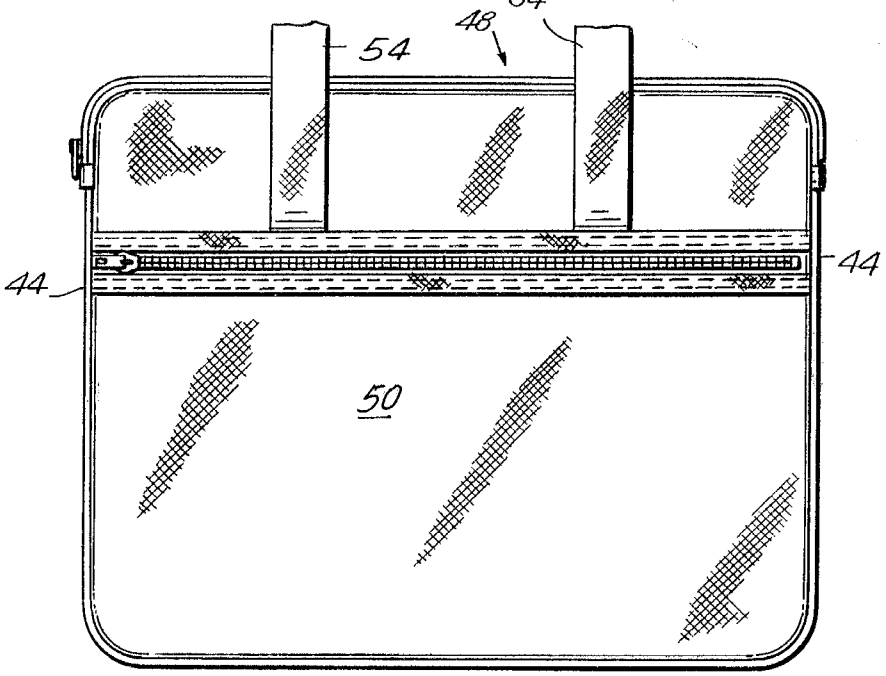
FIG. 4 is an elevational view similar to the view of FIG. 1, but showing the bag after it has been reversed.

By opening the reversible zipper 28 and turning the bag 10 inside out, the inner portions of the bag are now on the outside and the outer portions of the bag are on the inside (see FIG. 4). Since the zipper is reversible, it may be used for either arrangement of the bag. By providing different coloring for the inner portions than for the outer portions, it is possible to provide a reversible bag which can be used with fashion designs of different colors. Moreover, if desired, various types of other designs may be provided on the inner or outer portions of the bag. For instance, the outer front portion 12, which does not have a pocket, is provided with stitching 56 and a flat strip 58, so that it will match in appearance the outer rear portion 14 which is provided with a pocket. Similarly, the inner rear portion 42 may also be provided with such an arrangement. Thus, a bag can be provided for use with two different coordinated fashion outfits.

Though FIGS. 1–4 illustrate an embodiment with an essentially rectangular, tote-like bag, the invention is applicable to bags of any shape or size. The important concept is that a reversible bag is provided with a reversible zipper to close the top. The number of shapes and sizes of the bag is only limited by the imagination of the designer. Any size and shape bag can be made reversible and, if a reversible zipper is placed on the top portion, it comes within the scope of this invention.

It must also be appreciated that the bags in question can be made without any pockets at all. Further, it is possible to provide pockets on both the rear and front portions of both the outer and inner sides of the bag. In the case of a bag similar to the one shown in FIGS. 1–4, it is even possible to provie pockets along the inner and outer side portions 44 and 16. Other suitable means may be used for attaching pockets to the reversible bag. For instance, rivets may be used to attach the four corners of a pocket to a respective surface of one of the fron or rear portions of the bag (see FIG. 5). Instead of the rivets, or possibly in addition thereto, stitches may be used to attach the pocket. In fact, such a pocket could even be attached to the outer pocket panel and thus provide a second pocket on the respective surface of the bag. The number of pockets positioned on any given surface of the bag is only limited by the size of the pockets and the surface area of the respective surface.

As for the handles of the bag, they may be placed (as shown in FIGS. 1, 2 and 4) along the front and rear portions of the bag at a point below the top portion of the bag. In other embodiments, it may be desirable to attach the handles directly to the top portion of the bag (See FIGS. 5 and 9). In still other embodiments, it may be desirable to position the handles to the top portions of the side portions of the bag (See FIG. 11). The length of the handle is dependent on whether a shoulder-type bag is desired, or merely a hand bag. Further, the handles may even be detachable.

By way of example, some of the other possible shapes and sizes of the reversible bag will be presented. It must be stated that the concept of this invention is applicable to all other possible shapes and sizes. These examples are provided merely to illustrate some of the other possible embodiments of this invention and are not intended to limit the scope of application of this invention.

The bag of this invention may comprise a clutch or purse-type bag with a zipper top and no handles. Hobo bags of varying sizes may also be the subject of this invention. Camera cases or shoulder bags of varying sizes may also be the subject of this invention. Large or small north-south or east-west, tote bags may be used. Various sized attache type bags or traveler bags may be made into a reversible bag with a zipper top. Duffle bags or barrel shaped bags may also be made reversibe. Even conventional type hand bags may be made of a reversible nature.

Referring now to FIGS. 5–8, a unique traveler type bag 68 is shown. In addition to the bag being reversible, it also includes a longitudinal outer pocket 70 positioned with respect to one of the outer sidewalls 74 of the bag. Within the interior 76 of the bag is an inner longitudinal pocket 72 positioned with respect to one of the inner sidewalls 78.

Each of the longitudinal pockets is constructed in substantially the same manner. Front and rear panels 80 and 82 are suitably attached to the appropriate sidewalls of the bag. A side panel 84 is suitably attached between the front and rear panels 80 and 82. Between the top portions of the front and rear panels 80 and 82, the top portion of the respective sidewalls of the bag and the side panel 84 a top panel 86 is suitably attached. Any desirable means may be used for attaching the various panels, but stitching is the preferred method. A zipper closure means 88 may be provided in the top panel 86. This zipper may be attached in the same manner as the zipper 28 is attached to the bag in general.

Figure 6:
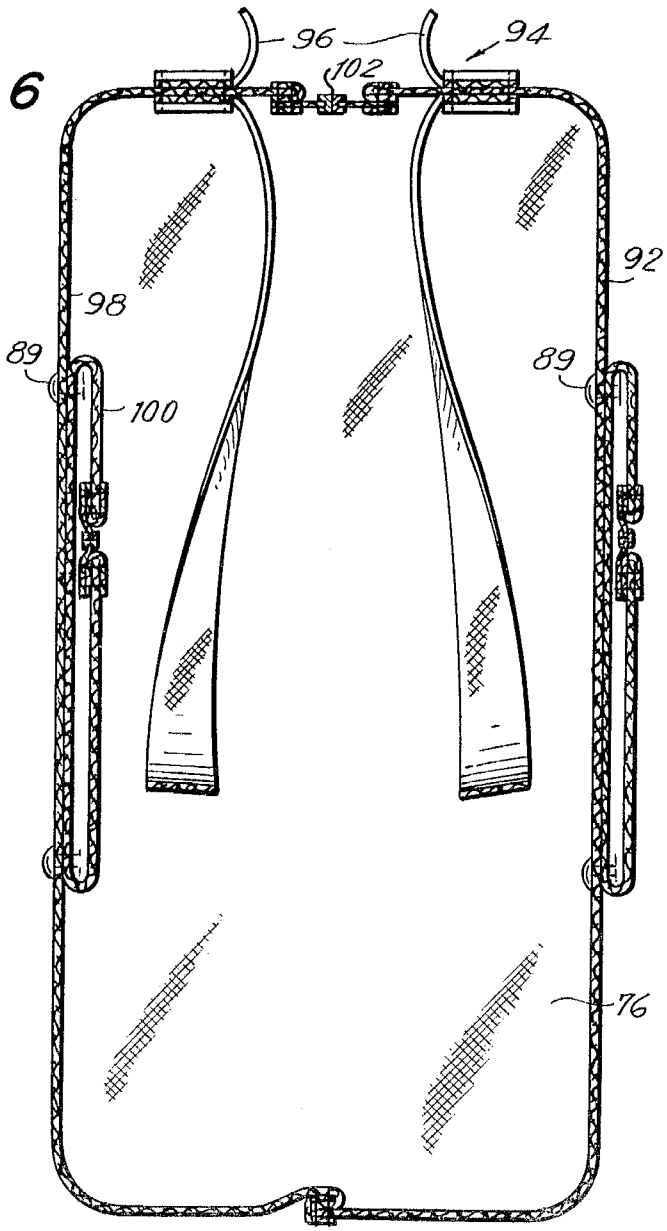
FIG. 6 is a cross-sectional view taken substantially along the lines 6—6 of FIG. 5, and showing in the interior of the bag the exterior pocket and handles for the bag when it is reversed.
Figure 5:
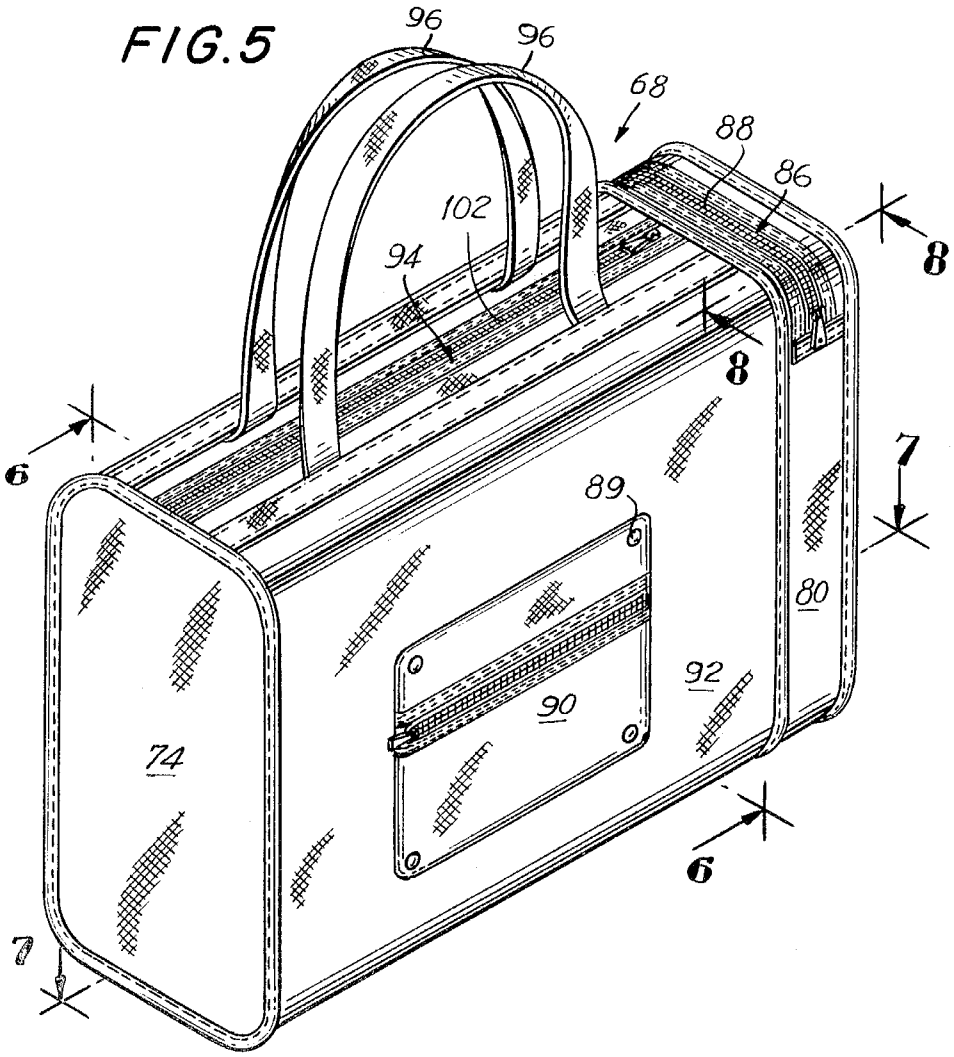
FIG. 5 is a perspective view of an alternate embodiment of the reversible bag, including a longitudinal pocket along one of the side walls of the bag.
Figure 7:
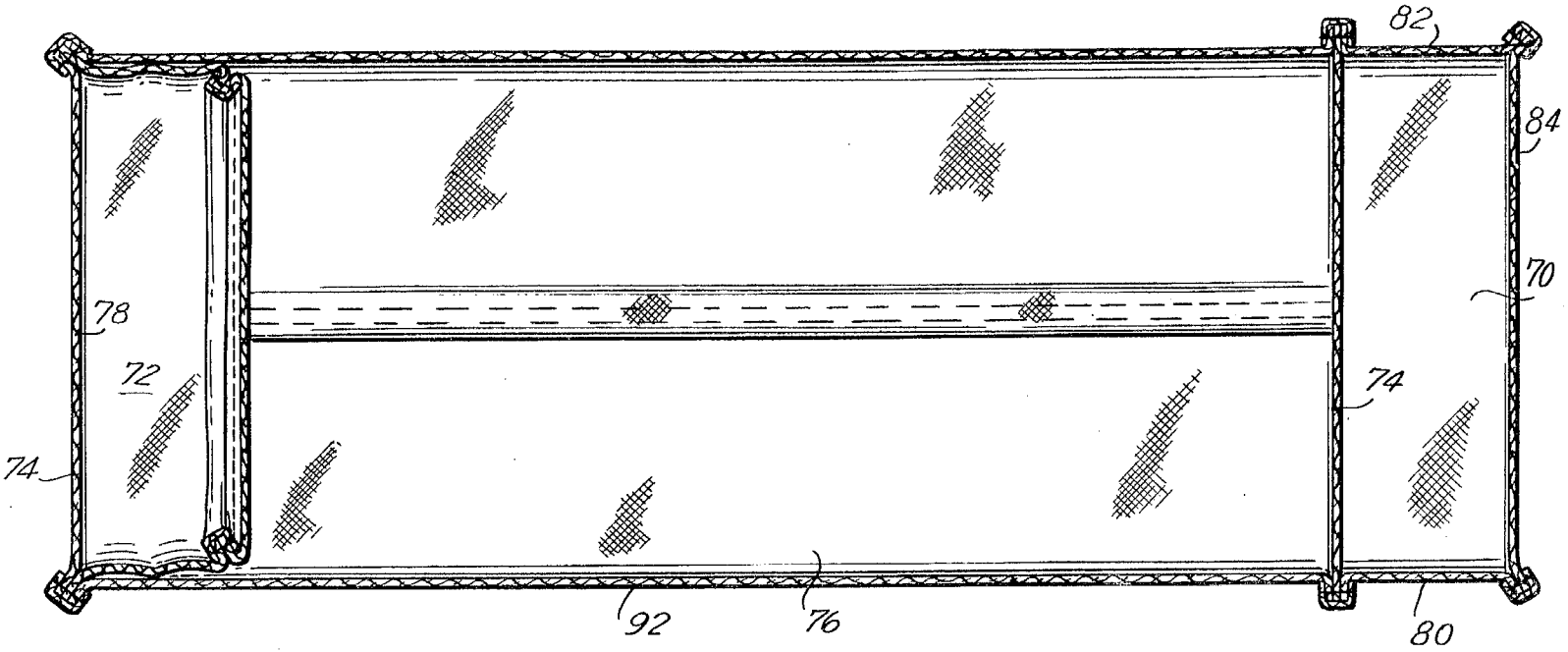
FIG. 7 is a cross-sectional view taken substantially along the lines 7—7 of FIG. 5, and showing in the interior of the bag the longitudinal sidewall pocket for the bag when the bag is reversed.
Figure 8:
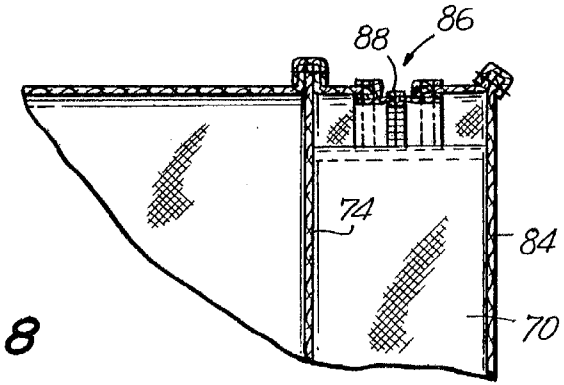
FIG. 8 is a cross-sectional view taken substantially along the lines 8—8 of FIG. 5, and showing the manner in which the longitudinal pocket is attached to the sidewall of the bag.

As is clearly shown in FIG. 5, rivets 89 may be used to secure the pocket panel 90 to the outer front portion 92 of the bag 68. In addition to the rivets 88, the pocket panel 90 may be stitched to the front portion 92 along three sides. Further, a pocket panel 90 may be riveted to the pocket panel 30 provided on the outer front portion 12 of the reversible bag 10 shown in FIGS. 1–4. As shown in FIG. 6, the interior portion of the bag 68 may also be provided with a pocket panel 100. This pocket panel may be attached in any of the above-mentioned manners.

Along a top portion 94 of the bag 68, handles 96 may be secured. The reversible zipper 102, in this embodiment, only extends along the top portion 94 of the bag. Unlike the embodiment shown in FIGS. 1–4, it does not extend down along the side portions of the bag.

Figure 10:
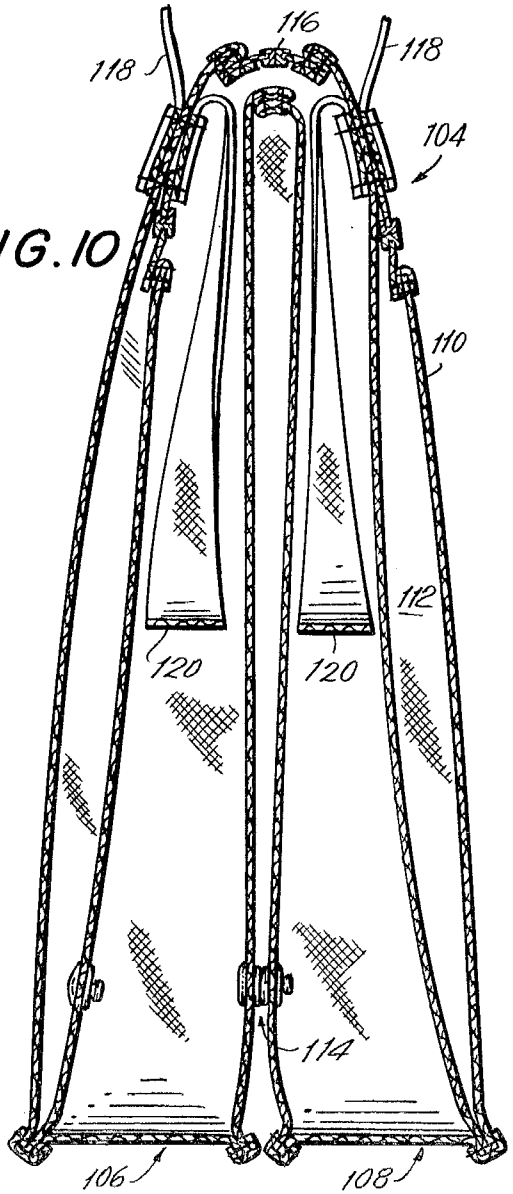
FIG. 10 is a cross-sectional view taken substantially along the lines 10—10 of FIG. 9.
Figure 9:
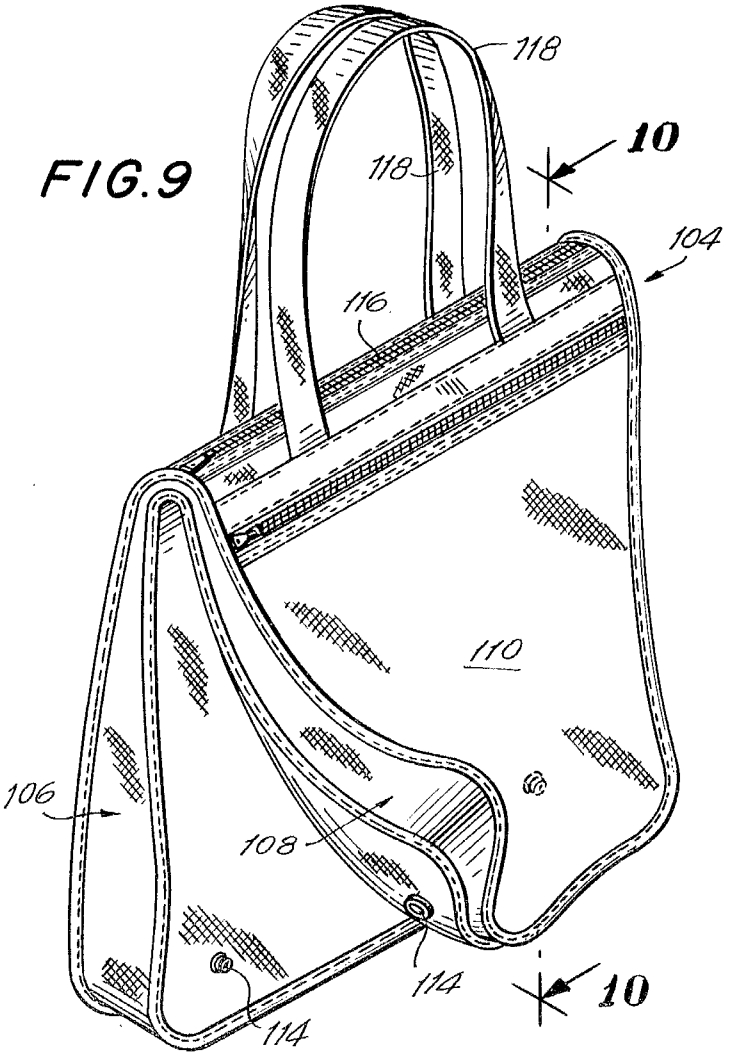
FIG. 9 is a perspective view of a second alternate embodiment of the invention.

Another unique type of reversible bag is illustrated in FIGS. 9 and 10. This bag is a reversible and foldable bag 104. This bag consists of two foldable portions 106 and 108 each of which is reversible. As on the other previously discussed bags, each of these foldable portions may include a pocket panel 110 to define a pocket 112. Mating snaps 114 may be provided on the surfaces of the foldable portions that face each other. Preferably, if snaps are included, they should be provided on each side of each foldable portion.

At the intersection of the two foldable portions 106 and 108, a reversible zipper 116 may be provided. By laying each foldable portion flat and opening the zipper 116, access to the interior regions of each foldable portion may be attained. Then, each foldable portion may be turned inside out. By such means, the entire bag 104 is effectively turned inside out and a new color or design of the bag may be revealed.

In the preferred arrangement, handles 118 may be provided at the intersection of the two foldable portions. If desired, the handles may be attached to each of the foldable portions. Similarly, handles 120 should be provided in the interior regions of the two foldable portions so that, when the bag is reversed, there will be handles.

Figure 12:
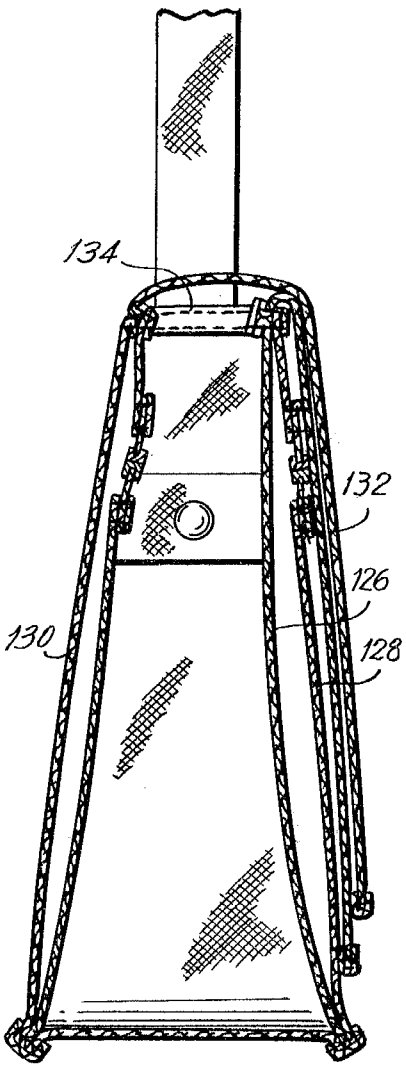
FIG. 12 is a cross-sectional view taken substantially along the lines 12—12 of FIG. 11.
Figure 13:
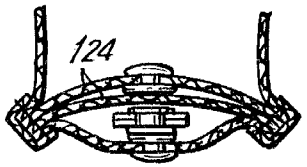
FIG. 13 is a cross-sectional view taken substantially along the lines 13—13 of FIG. 11, and showing one manner in which to attach the handles to the bag shown in FIG. 11.
Figure 11:
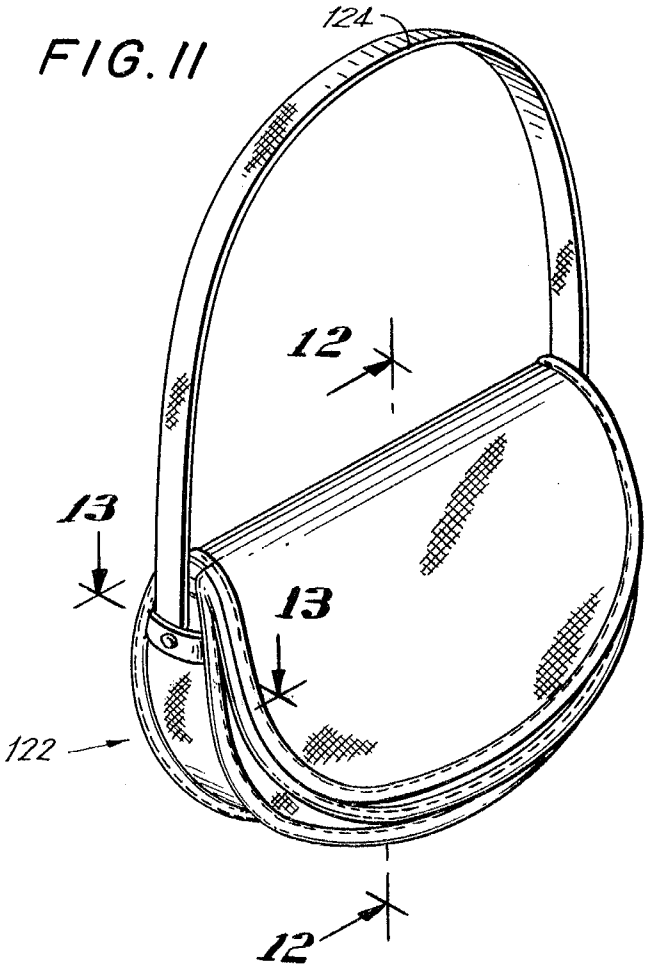
FIG. 11 is a perspective view of a third alternate embodiment of the invention, wherein the bag has a flap top instead of a zipper cosure means.

FIGS. 11–13 illustrate yet another embodiment of the proposed invention. The bag 122 is essentially in the shape of a conventional handbag. FIG. 13 illustrates the manner in which a handle 124 may be attached to the bag 122. As can be seen, a conventional structure is used, but any other suitable means may be used. If desired, such handles 124 may be detachable.

In outer front portion 126 of the bag includes an upper flap or extension portion 128. This portion 128 folds down over the remaining portion of the front portion 126. The outer back portion 130 also includes a flap or extension portion 132. This extension portion 132 extends over the open top 134 of the bag and overlies the extension 128 and the front portion 126. By the provision of the flaps or extension portions, the inner region of the bag is essentially closed. A reversible zipper is included to close the opening 134. Because of the unique construction of the extensions or flaps, this bag may be made without the reversible zipper.

When the bag is turned inside out, the extension portions operate in a similar manner to close the bag.

As stated above, each of the above discussed embodiments is only one example of the many different shapes, sizes and configurations that fall within the scope if this invention. In fact, the only limitation on the scope of the invention is the imagination of the designer.

Each of the reversible bags of this invention may be made of nylon. In the preferred case, cire nylon or calendered nylon may be used. Further, if desired, the nylon may be quilted. This material is preferred because it is lightweight and washable. It must be pointed out, however, that the invention will work equally well with any other material. Canvas, cotton and vinyl are just some of the other materials out of which the invention may be made. Preferably, a 100% polyester filling is provided, but any suitable filling may be used. The handles may preferably be made from 100% nylon, or even possible woven cotton. Any suitable strong material, however, may be used for the manufacture of the handles. The binding around the zipper and the top portions of the bag may be made of crosgrain, but other suitable materials may be used. In the preferred embodiments, the zippers are made of brass, but they can obviously be made of almost any material, such as metal, plastic or even nylon.

Moreover, in other embodiments of the invention it is possible to provide the side panels of the bag with accordion folds or gussets. In fact, in hand bag type embodiments, the side panels may be essentially triangular in shape and relatively narrow. In some other bags, the rear and front portions may be connected directly together, and there will effectively be no side panels. This would not alter the essence of the invention, so long as the bag had finished inner and outer surfaces so that it could be made reversible.

We claim:

1. A reversible bag having inner and outer portions with finished surfaces, wherein the improvement comprises a reversible zipper to open and close an opening into an interior of said reversible bag, and wherein handles are attached to said inner portion and to said outer portion of said reversible bag, and at least one pocket is provided on at least one surface of the reversible bag.

2. A reversible bag according to claim 1, wherein at least one pocket is provided on one of the surfaces of the inner portion of the reversible bag and at least one pocket is provided on one of the surfaces of the outer portion of the reversible bag.

3. A reversible bag according to claim 1, wherein said handles are attached to a top portion of said reversible bag.

4. A reversible bag according to claim 1, wherein said handles are attached to top portions of side panels of said reversible bag.

5. A reversible bag having inner and outer portions with finished surfaces, wherein the improvement comprises a reversible zipper to open and close an opening into an interior of said reversible bag, and wherein handles are attached to said inner portion and to outer portion of said reversible bag.

6. A reversible bag according to either claim 1 or 5, wherein at least one pocket is provided on a side portion of said reversible bag.

7. A reversible bag according to claim 5, wherein webbings of said reversible zipper are attached to opposing sides of the reversible bag defining said opening into said interior of the reversible bag.

8. A reversible bag according to claim 7, wherein strippings are folded over said webbings of said reversible zipper.

9. A reversible bag according to either claim 7 or 8, wherein strippings are folded over said opposing sides of the reversible bag.

* * * * *